US006328413B1

(12) United States Patent
Rutland et al.

(10) Patent No.: US 6,328,413 B1
(45) Date of Patent: Dec. 11, 2001

(54) INKJET PRINTER SPITTING METHOD FOR REDUCING PRINT CARTRIDGE CROSS-CONTAMINATION

(75) Inventors: Jeffrey D Rutland, San Diego; Grant A Webster, Valley Center, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/629,231

(22) Filed: Jul. 31, 2000

(51) Int. Cl.[7] ..... B41J 2/165
(52) U.S. Cl. ..... 347/35; 347/24
(58) Field of Search ..... 347/21, 22, 23, 347/24, 34, 35, 37, 39, 96, 102, 101

(56) References Cited

U.S. PATENT DOCUMENTS 5,363,132 * 11/1994 Ikkatai ..... 347/24
5,680,162 * 10/1997 Taylor et al. ..... 347/35
5,805,182 * 9/1998 Lee ..... 347/35
6,231,156 * 5/2001 Ono ..... 347/24

* cited by examiner

*Primary Examiner*—John Barlow
*Assistant Examiner*—Blaise Mouttet
(74) *Attorney, Agent, or Firm*—Dennis G. Stenstrom

(57) ABSTRACT

A method for minimizing cross-contamination of print cartridges in an inkjet printing system due to aerosol drift by employing a bi-directional spitting scheme coupled with a configuration of the print cartridges. The method includes a carriage for traversing across a print medium and a spittoon, the carriage having a plurality of N receptacles, the receptacles identified from left to right as positions 1 through N, includes mounting a reactive print cartridge in either positions 1 and N, or both, on the carriage, the reactive print cartridges having a plurality of nozzles for ejecting reactive droplets and mounting a plurality of print cartridges in the remaining positions on the carriage, the print cartridges having a plurality of nozzles for ejecting ink droplets. During operation of the printing system, depending on the number of reactive print cartridges and the number of print cartridges and the location thereof, intermittently ejecting non-printing ink and reactive droplets from the print cartridges in a specific order while the carriage is moving in a transverse left to right direction and ejecting ink and reactive droplets from the print cartridges in a specific order while the carriage is moving in a transverse right to left direction.

24 Claims, 5 Drawing Sheets

INKJET PRINTER SPITTING METHOD FOR REDUCING PRINT CARTRIDGE CROSS-CONTAMINATION

CROSS-REFERENCE TO RELATED APPLICATIONS

This application is related to U.S. patent application Ser. No. 09/563,008, filed Apr. 29, 2000, entitled "A Method for Using Highly Energetic Droplet Firing Events to Improve Droplet Ejection Reliability" The foregoing commonly assigned patent application is herein incorporated by reference.

FIELD OF THE INVENTION

This invention relates to thermal inkjet printers, and more particularly to the maintenance of inkjet print cartridges.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988). The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994)], incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting ink ejection elements. The carriage traverses over the surface of the print medium, and the ink ejection elements are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle and has a firing resistor located in the chamber. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

In an inkjet printhead the ink is fed from an ink reservoir integral to the printhead or an "off-axis" ink reservoir which feeds ink to the printhead via tubes connecting the printhead and reservoir. Ink is then fed to the various vaporization chambers either through an elongated hole formed in the center of the bottom of the substrate, "center feed", or around the outer edges of the substrate, "edge feed."

The ink cartridge containing the ink ejection elements is moved repeatedly across the width of the medium to be printed upon. At each of a designated number of increments of this movement across the medium, each of the resistors is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

Thermal inkjet printheads require an electrical drive pulse from a printer in order to eject a drop of ink. The voltage amplitude, shape and width of the pulse affect the printhead's performance. It is desirable to operate the printhead using pulses that deliver a specified amount of energy. The energy delivered depends on the pulse characteristics (width, amplitude, shape), as well as the resistance of the printhead.

A thermal inkjet printhead requires a certain minimum energy to fire ink drops of the proper volume (herein called the turn-on energy). Turn-on energy can be different for different printhead designs, and in fact varies among different samples of a given printhead design as a result of manufacturing tolerances. These tolerances add to the uncertainty in knowing how much energy is being delivered to any given printhead. Therefore, it is necessary to deliver more energy to the average printhead than is required to fire it (called "over-energy") in order to allow for this uncertainty As a result, thermal inkjet printers are configured to provide a fixed ink firing energy that is greater than the expected lowest turn-on energy for the printhead cartridges it can accommodate. A consideration with utilizing a fixed ink firing energy is that firing energies excessively greater than the actual turn-on energy of a particular printhead cartridge result in a shorter operating lifetime for the heater resistors and degraded print quality.

Inkjet print cartridges can suffer from many sources of droplet ejection problems such as the formation of a viscous plug in the nozzle region resulting in a droplet that is difficult or impossible to eject, or formation of bubbles in the firing chamber that can cause misdirected ejection or no ejection at all. These problems can induce droplet trajectory errors, or can cause a nozzle to fail completely. These and other problems can occur when a particular nozzle has been inactive for some period of time when the printer is not in use. Also, when a page is printed not all of the nozzles on a print cartridge are necessarily used. The sensitivity of a particular inkjet system to these problems is highly dependent on the ink formulation, the geometry of the nozzle and firing chamber, and temperature.

Periodic "fly-by" spitting of the nozzles is a method for preventing or curing these reliability problems caused by nozzle inactivity. Spitting is the ejection of non-printing ink drops during printing operations and also spitting during routine servicing of the print cartridges. However, spitting in the spittoon causes a higher occurrence of aerosol due to the distance the droplet has to fly before it hits the absorber (less aerosol is generated while printing on media). Attempts in previous products have been made to minimize the distance from the printhead to the absorber. Some products have used what they call an 'active chimney' which is a plastic wheel that is spit on instead of an absorber, the wheel is indexed and the dry inked scraped off into a 'bucket.' These solutions address overall aerosol, which primarily results in cosmetic issues such as build-up on the inside of the printer. They do not provide adequate aerosol solutions in the case where there is a chemical reaction between ink and fixer in two or more adjacent print cartridges. When ink types between the different inkjet print cartridges are incompatible, additional failures can occur if the incompatible inks mix on the inkjet print cartridge nozzle member. This problem also occurs in ink systems which use one or more print cartridges containing a "fixer" solution which is designed to be chemically reactive with the inks so as to "fix" the inks on the media. This cross-contamination of inks, or fixer and ink, can occur during fly-by spitting due to aerosol drifting "downwind" and landing on the nozzle member of adjacent inkjet print cartridges. This cross-contamination of inks, or fixer and ink, on the nozzle member of inkjet print cartridges can cause nozzle blockage.

Accordingly, it would be advantageous to have a method to that reduces ink cross-contamination of print cartridges in inkjet printers during fly-by spitting.

SUMMARY OF THE INVENTION

The method of the present invention minimizes cross-contamination of print cartridges in an inkjet printing system due to aerosol drift by employing a bidirectional spitting scheme coupled with a configuration of the print cartridges. The method of operating an inkjet printing system having a carriage for traversing across a print medium and a spittoon, the carriage having a plurality of N receptacles, the receptacles identified from left to right as positions 1 through N, includes mounting a reactive print cartridge in either positions 1 and N, or both, on the carriage, the reactive print cartridges having a plurality of nozzles for ejecting reactive droplets and mounting a plurality of print cartridges in in the remaining positions on the carriage, the print cartridges having a plurality of nozzles for ejecting ink droplets. During operation of the printing system, depending on the number of reactive print cartridges and the number of print cartridges and the location thereof, intermittently ejecting non-printing ink and reactive droplets from the print cartridges in a specific order while the carriage is moving in a transverse left to right direction and ejecting ink and reactive droplets from the print cartridges in another specific order while the carriage is moving in a transverse right to left direction.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF A PREFERRED EMBODIMENT

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

Figure 1:
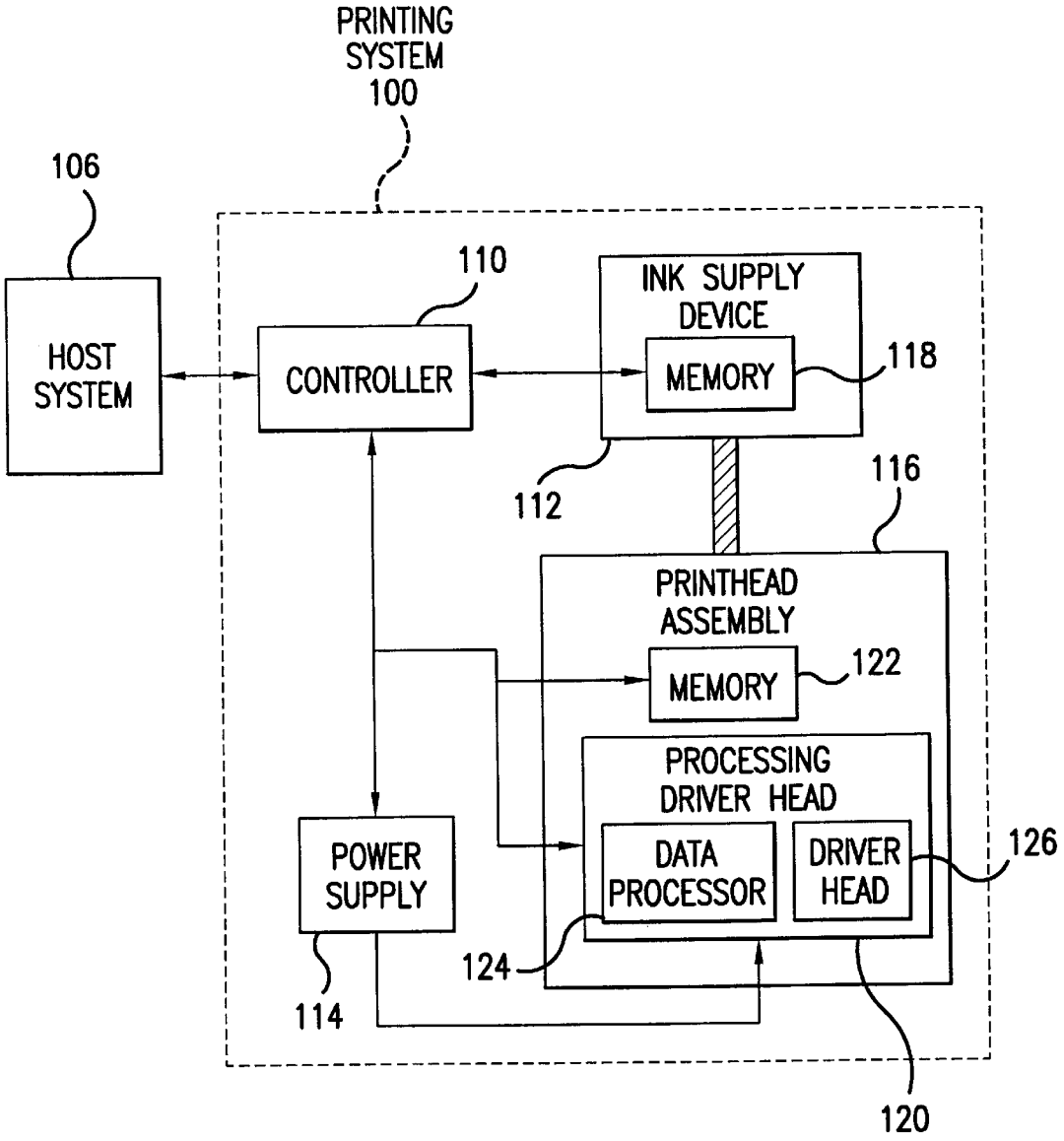
FIG. 1 shows a block diagram of an overall printing system incorporating the present invention.

FIG. 1 shows a block diagram of an overall printing system incorporating the present invention. The printing system 100 can be used for printing a material, such as ink on a print media, which can be paper. The printing system 100 is electrically coupled to a host system 106, which can be a computer or microprocessor for producing print data. The printing system 100 includes a controller 110 coupled to an ink supply device 112, a power supply 114 and a printhead assembly 116. The ink supply device 112 includes an ink supply memory device 118 and is fluidically coupled to the printhead assembly 116 for selectively providing ink to the printhead assembly 116. The printhead assembly 116 includes a processing driver head 120 and a printhead memory device 122. The processing driver head 120 is comprised of a data processor 124, such as a distributive processor, and a driver head 126, such as an array of inkjet ink ejection elements or drop generators 416.

During operation of the printing system 100, the power supply 114 provides a controlled voltage to the controller 110 and the processing driver head 120. Also, the controller 110 receives the print data from the host system and processes the data into printer control information and image data. The processed data, image data and other static and dynamically generated data (discussed in detail below), is exchanged with the ink supply device 112 and the printhead assembly 116 for efficiently controlling the printing system.

The ink supply memory device 118 can store various ink supply specific data, including ink identification data, ink characterization data, ink usage data and the like. The ink supply data can be written and stored in the ink supply memory device 118 at the time the ink supply device 112 is manufactured or during operation of the printing system 100. Similarly, the printhead memory device 122 can store various printhead specific data, including printhead identification data, warranty data, printhead characterization data, printhead usage data, etc. This data can be written and stored in the printhead memory device 122 at the time the printhead assembly 116 is manufactured or during operation of the printing system 100.

Although the data processor 124 can communicate with memory devices 118, 122, the data processor 124 preferably primarily communicates with the controller 110 in a bidirectional manner. The bidirectional communication enables the data processor 124 to dynamically formulate and perform its own firing and timing operations based on sensed and given operating information for regulating the temperature of, and the energy delivered to the processing driver head 120. These formulated decisions are preferably based on, among other things, sensed printhead temperatures, sensed amount of power supplied, real time tests, and preprogrammed known optimal operating ranges, such as temperature and energy ranges. As a result, the data processor 124 enables efficient operation of the processing driver head 120 and produces droplets of ink that are printed on a print media to form a desired pattern for generating enhanced printed outputs.

Figure 2:
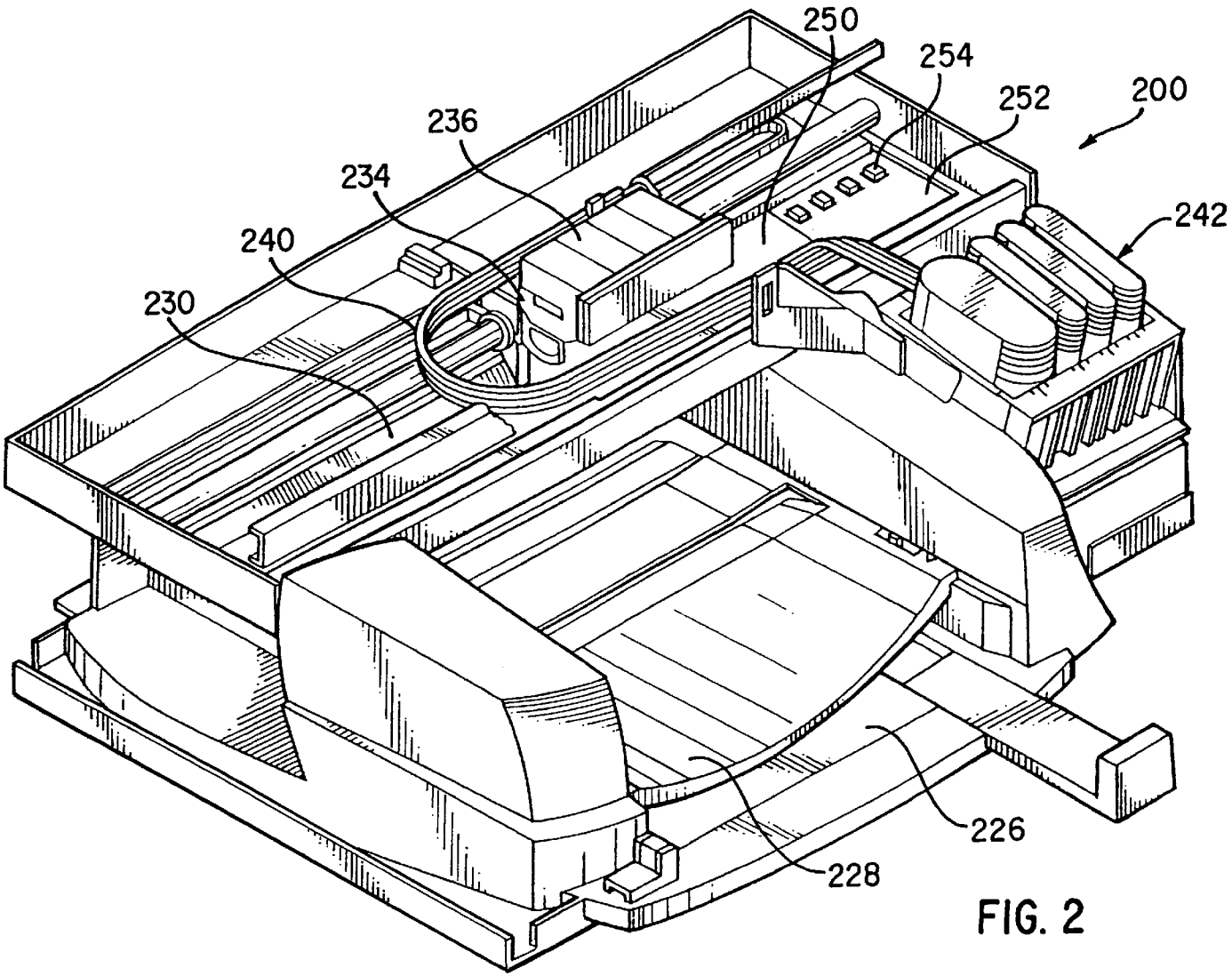
FIG. 2 is an exemplary printer that incorporates the invention and is shown for illustrative purposes only.

FIG. 2 is an exemplary high-speed printer that incorporates the invention and is shown for illustrative purposes only. Generally, printer 200 can incorporate the printing system 100 of FIG. 1 and further include a tray 226 for holding print media. When a printing operation is initiated, print media, such as paper, is fed into printer 200 from tray 226 preferably using a sheet feeder. The sheet then brought around in a U direction and travels in an opposite direction toward output tray 228. Other paper paths, such as a straight paper path, can also be used. The sheet is stopped in a print zone 230, and a scanning carriage 234, supporting one or more print cartridges 236 (an example of printhead assembly 116 of FIG. 1), is then scanned across the sheet for printing a swath of ink thereon. After a single scan or multiple scans, the sheet is then incrementally shifted using, for example, a stepper motor and feed rollers to a next position within the print zone 230. Carriage 234 again scans across the sheet for printing a next swath of ink. The process repeats until the entire sheet has been printed, at which point it is ejected into output tray 228. Scanning carriage 234 may also support one or more "special" print cartridges as discussed below.

Also shown in FIG. 2 is a spittoon 250 into which print cartridges 236 eject non-printing ink drops during printing operations and also spitting during routine servicing of the print cartridges 236. As shown in FIG. 2, spittoon 250 is located on the right side just out of the print zone of printer 200. During printing operation if spitting is required the carriage 234 moves the print cartridges 236 beyond the print zone so the print cartridges 236 can "spit on the fly," i.e., "fly-by spitting," as the print cartridges move over the spittoon 250. While in FIG. 2 the spittoon 250 is shown only on the right side of the print zone, a spittoon can also be placed on both sides of the print zone so that the print cartridges 236 can spit into a spittoon moving in both directions on both sides of the print zone as the carriage 234 moves the cartridges 236 beyond the print zone on either side. Also shown is the capping station 252 where the print cartridges 236 are individually capped by caps 254 when not printing. It should also be appreciated that during printing operation if spitting is required the spitting may be performed onto the print media as the carriage 234 moves the print cartridges 236 over the media in either direction. This spitting onto the media may be possible because the ink droplets may be so small that individual drops on the media are imperceptible to the human eye.

The print assemblies 236 can be removably mounted or permanently mounted to the scanning carriage 234. Also, the printhead assemblies 236 can have self-contained ink reservoirs (for example, the reservoir can be located within printhead body 304 of FIG. 3). Alternatively, each print cartridge 236 can be fluidically coupled, via a flexible conduit 240, to one of a plurality of fixed or removable ink containers 242 acting as the ink supply 112 of FIG. 1. As a further alternative, the ink supplies 112 can be one or more ink containers separate or separable from print cartridge 236 and removably mountable to carriage 234.

Figure 3:
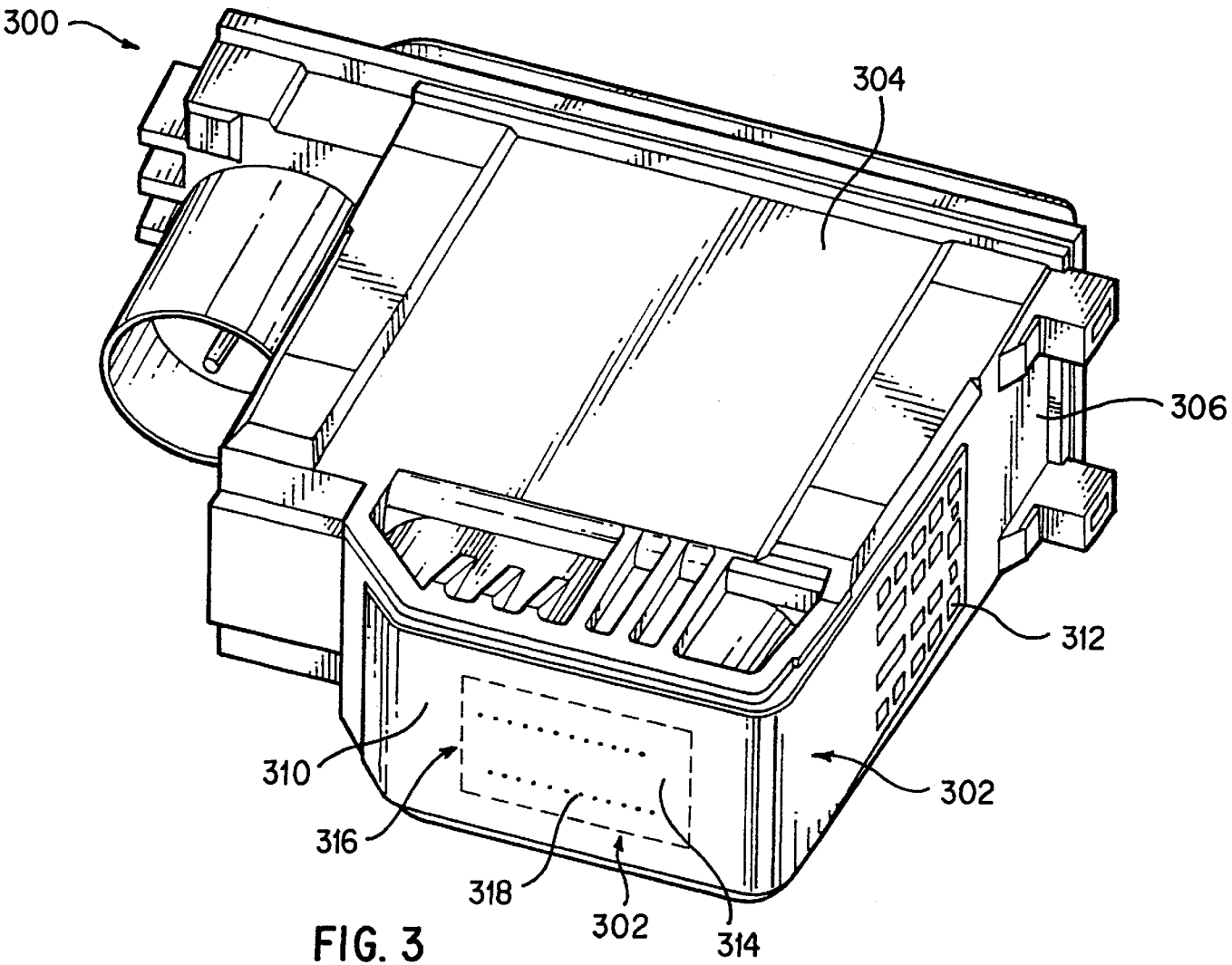
FIG. 3 shows for illustrative purposes only a perspective view of an exemplary print cartridge incorporating the present invention.

FIG. 3 shows for illustrative purposes only a perspective view of an exemplary printhead assembly 300 (an example of the printhead assembly 116 of FIG. 1) incorporating the present invention. A detailed description of the present invention follows with reference to a typical printhead assembly used with a typical printer, such as printer 200 of FIG. 2. However, the present invention can be incorporated in any printhead and printer configuration. The printhead assembly 300 is comprised of a thermal inkjet head assembly 302, a printhead body 304 and a printhead memory device 306, (an example of memory device 122 of FIG. 1). The thermal head assembly 302 can be a flexible material commonly referred to as a Tape Automated Bonding (TAB) assembly and can contain a processing driver head 310 (an example of processing driver head 120 of FIG. 1) and interconnect contact pads 312. The interconnect contact pads 312 are suitably secured to the print cartridge 300. The contact pads 312 align with and electrically contact electrodes (not shown) on carriage 234 of FIG. 2.

The processing driver head 310 comprises a distributive processor 314 (an example of the data processor 124 of FIG. 1) preferably integrated with a nozzle member 316 (an example of driver head 126 of FIG. 1). The nozzle member 316 preferably contains plural orifices or nozzles 318, which can be created by, for example, laser ablation, for creating ink drop generation on a print media.

The distributive processor 314 preferably includes digital circuitry and communicates via electrical signals with the controller 110, nozzle member 316 and various analog devices, such as temperature sensors which can be located on the nozzle member 316. The distributive processor 314 communicates with the controller in a bidirectional manner over a bidirectional data line. The controller sends commands to the distributive processor and receives and processes signals from the distributive processor.

The distributive processor 314 makes decisions and actions based on its input signals. For example, controlling firing, timing, thermal and energy aspects and pulse width decisions of the printhead assembly 300 and nozzle member 316 timing can be made by the distributive processor. These decisions may alternatively may be made by the controller 110 of the printing system. The distributive processor 314 also receives sensor signals from temperature sensors located on the driver head 310. The temperature sensors can also be connected to the controller 110 via a direct connection or through the printer's memory device for continuously updating the controller.

Figure 4:
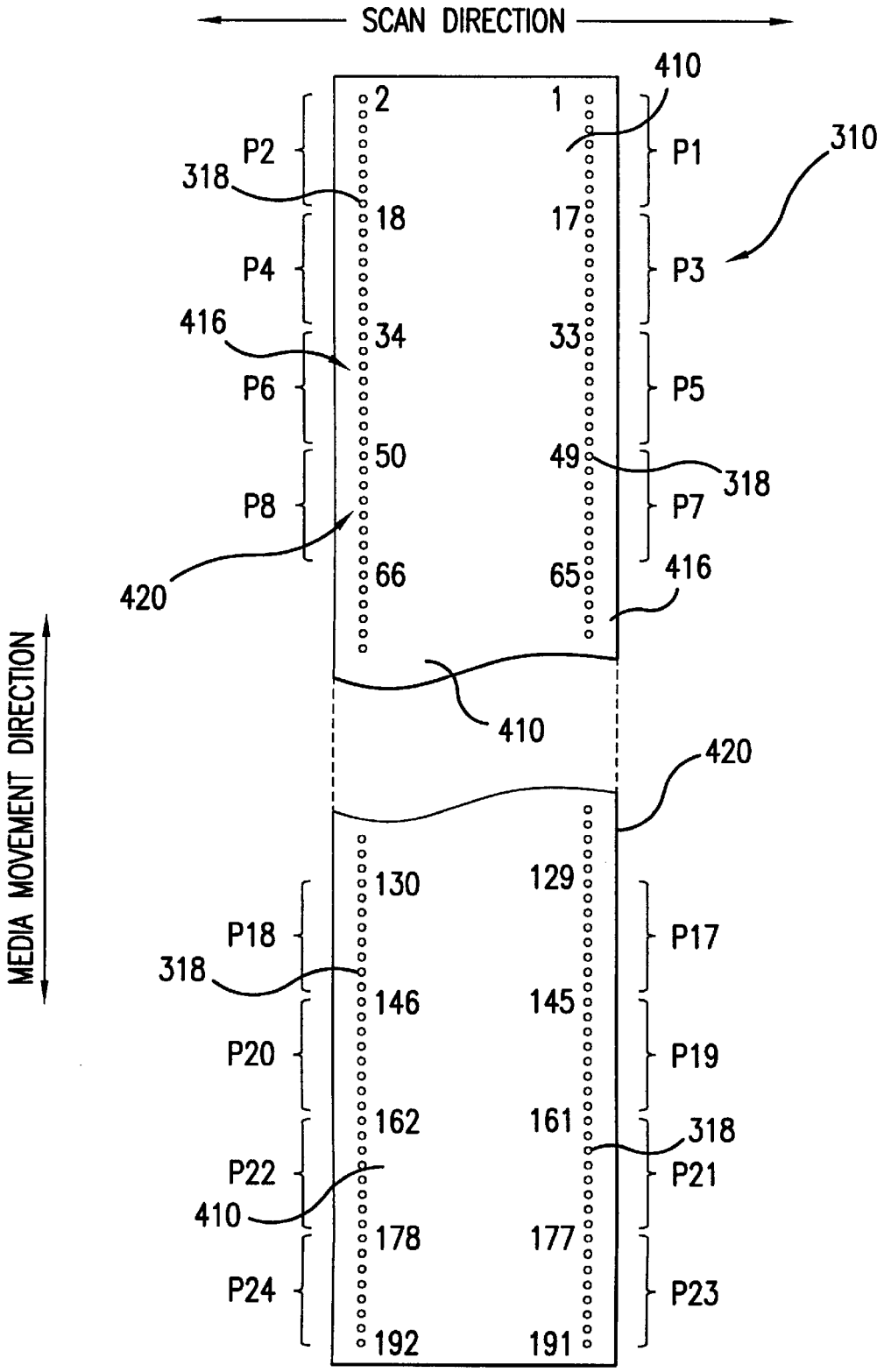
FIG. 4 is a detailed view of the integrated processing driver head of FIG. 3 showing the distributive processor and the resistor and primitive layout of the driver head of the printhead assembly.

FIG. 4 is a detailed view of an exemplary integrated processing driver head of FIG. 3 showing the distributive processor and the driver head of the printhead assembly. The elements of FIG. 4 are not to scale and are exaggerated for simplification. Referring to FIGS. 1–3 along with FIG. 4, as discussed above, conductors (not shown) are formed on the back of TAB head assembly 302 and terminate in contact pads 312 for contacting electrodes on carriage 234. The electrodes on carriage 234 are coupled to the controller 110 and power supply 114 for providing communication with the thermal head assembly 302. The other ends of the conductors are bonded to the processing driver head 310 via terminals or electrodes on substrate 410. The substrate 410 has ink ejection elements 416 formed thereon and electrically coupled to the conductors. The controller 110 and distributive processor 314 provide the ink ejection elements 416 with operational electrical signals.

A barrier layer (not shown) is formed on the surface of the substrate 410 to define ink ejection chambers, preferably using photo lithographic techniques, and can be a layer of photo resist or some other polymer. The ink ejection chamber (not shown) contains an ink ejection element 416 and is preferably located behind a single nozzle 318 of the nozzle member 316. A portion of the barrier layer insulates the conductive traces from the underlying substrate 410.

Each ink ejection element 416 ejects ink when selectively energized by one or more pulses applied sequentially or simultaneously to one or more of the contact pads 312. The ink ejection elements 416 may be heater resistors or piezoelectric elements. Each ink ejection element 416 is allocated to a specific group of ink ejection elements 416, hereinafter referred to as a primitive 420. The processing driver head 310 may be arranged into any number of multiple subsections with each subsection having a particular number of primitives containing a particular number of ink ejection elements 416. The nozzles 318 may be of any size, number, and pattern, and the various figures are designed to simply and clearly show the features of the invention. The relative dimensions of the various features have been greatly adjusted for the sake of clarity. In the case of FIG. 4, the processing driver head 310 has 192 nozzles with 192 associated firing ink ejection elements 416. There are preferably 24 primitives in two columns of 12 primitives each. The primitives in each column have 8 resistors each for a total of 192 resistors.

Additional details regarding the architecture and control of inkjet printheads are described in U.S. patent application Ser. No. 09/253,417, filed Feb. 19, 1999, entitled "A System and Method for Controlling Thermal Characteristics of an Inkjet Printhead;" U.S. patent application Ser. No. 09/016,478, filed Jan. 30, 1998, entitled "Hybrid Multi-Drop/Multi-Pass Printing System" and U.S. patent application Ser. No. 08/962,031, filed Oct. 31, 1997, entitled "Ink Delivery System for High Speed Printing" which are herein incorporated by reference.

The processing driver head 120, 310 is comprised of a data processor 124, such as a distributive processor 314, and a driver head 126, such as an array of inkjet ink ejection elements for ejecting ink drops. During operation of the printing system 100, the power supply 114 provides a controlled voltage or voltages to the printer controller 110 and the processing driver head 120. The data processor 124 can communicate with the controller 110 in a bidirectional manner with serial data communications. The bi-directional communication enables the data processor 314 to dynamically formulate and perform its own firing and timing operations based on sensed and given operating information for regulating and servicing the printhead assembly 116. These formulated decisions are based on printhead sensed temperature, printhead activity or inactivity, and the need for printhead servicing. Communication between the digital and analog devices and the distributive processor allows proper control and monitoring of the processing driver head 120, 310 such as enabling tests to be performed, sensed data to be interpreted, and the processing driver head 120 to be serviced, among other things.

The printing system 100 includes a controller 110 coupled to a printhead assembly 116. The printhead assembly 116 includes a processing driver head 120 and a printhead memory device 122 which can contain print cartridge calibration information. The processing driver head 120 is comprised of a data processor 124, such as a distributive processor, and a driver head 126, such as an array of inkjet ink ejection elements or drop generators 416. The driver head 126 further includes temperature sensors (not shown) for dynamically measuring the printhead temperature. Preferably the temperature sensors are distributed around the driver head so that a "global" temperature is sensed.

As discussed above, inkjet print cartridges can suffer from many sources of droplet ejection problems such as the formation of a viscous plug in the nozzle region resulting in a droplet that is difficult or impossible to eject, or formation of bubbles in the firing chamber that can cause misdirected ejection or no ejection at all.

These problems can induce droplet trajectory errors, or can cause a nozzle to fail completely. These and other problems can occur when a particular nozzle has been inactive for some period of time when the printer is not in use. Accordingly, spitting may be initiated to alleviate these problems whenever an ink ejection element/nozzle on a print cartridge has not been used for a predetermined maximum amount of time. Spitting is the ejection of non-printing ink drops during printing operations and also spitting during routine servicing of the print cartridges. This occurs when the printer is first turned on, or when the printer has been idle for some time. However, it also occurs when a page is being printed, because not all of the nozzles on a print cartridge are necessarily used. The sensitivity of a particular inkjet system to these problems is highly dependent on the ink formulation, the geometry of the nozzle 318 and ejection chamber, and temperature.

The controller 110 can monitor each print cartridge individually to determine when one or more ink ejection elements 416 on each print cartridge 236 has not been used for a predetermined maximum amount of time for each print cartridge. This predetermined maximum amount of time depends on the ink formulation, the geometry of the nozzle and ejection chamber. Accordingly, the predetermined maximum amount of time may be different for the black and the different color print cartridges. Moreover, the predetermined maximum amount of time may be different for viscous nozzle plugs and bubble induced ink ejection problems.

When one or more print cartridges 236 have not been used for a predetermined maximum amount of time during printing operations, controller 110 will use spitting on-the-fly while the print cartridges 236 are passing over the media or over the spittoon 250. All spitting at startup occurs over the spittoon 250.

Periodic "fly-by" spitting of the nozzles 318 is a method for preventing or curing these reliability problems caused by nozzle inactivity. However, when ink types between the different inkjet print cartridges 236 are incompatible, additional failures can occur if the incompatible inks mix on the inkjet print cartridge nozzle member 316. This problem also occurs in ink systems which use one or more print cartridges 236 containing either a "reactive" material such as an incompatible ink, a material designed to be chemically reactive with the inks so as to "fix" the inks on the media, or an "overcoat" material designed to be printed over the inks to make the inks more durable, smudge resistant, water resistant, UV resistant or lightfast.

This cross-contamination of inks, or fixer and inks, or overcoat and inks, can occur during fly-by spitting either onto the media, or into the spittoon 250 due to aerosol drifting "downwind" and landing on the nozzle member 316 of adjacent print cartridges 236. This cross-contamination of incompatible inks, fixer and ink, or overcoat and ink on the nozzle member of print cartridges 236 can cause nozzle 318 blockage. As used herein, a "reactive" print cartridge means a print cartridge containing an incompatible ink, a "fixer" material designed to be chemically reactive with the inks so as to "fix" the inks on the media, or an "overcoat" material designed to be printed over the inks.

The method of the present invention minimizes cross-contamination due to aerosol drift by employing a multi-pass spitting scheme which is coupled with the configuration of the print cartridges 236 in the carriage 234. When the carriage 234 goes over the spittoon 250, it crosses the spittoon 250 twice; once in the left to right direction, and once in the right to left direction. These two passes can be used advantageously such that cross-contamination between the "reactive" cartridges and other print cartridges is minimized.

Figure 5:
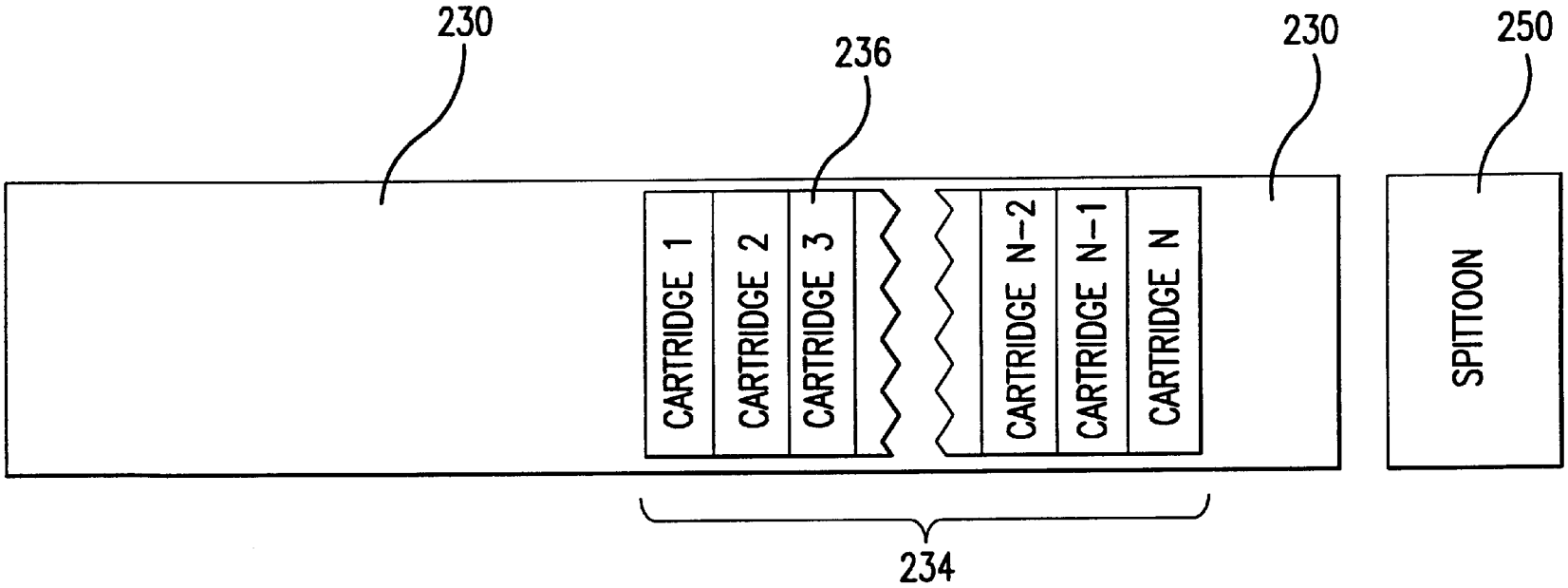
FIG. 5 is a schematic showing the print zone, carriage, print cartridges, reactive cartridges and spittoon of a printing system.

FIG. 5 shows a 'view from above' of the print zone 230 of a typical inkjet printer. The N print cartridges 236 are ordered in the carriage from left to right; Cartridge 1, Cartridge 2, Cartridge 3, . . . , Cartridge N−2, Cartridge N−1, Cartridge N. The "reactive" print cartridges are located on either the left (Cartridge 1), the right (Cartridge N), or on both ends (Cartridges 1 and N) of the scanning carriage 234. As shown in FIG. 5, there is one spittoon 250 to the right of the print zone. If there was another spittoon to the left of the print zone the same directional rules would apply for spitting that spittoon. To minimize cross-contamination of the "reactive" print cartridges and the color print cartridges, one would like to impose the rule that a "reactive" print cartridge cannot spit into the spittoon when an adjacent print cartridge 236 is downwind. Likewise, a print cartridge cannot spit into the spittoon 250 when an adjacent "reactive" print cartridge is downwind.

Table I shows the generalized spitting order for the N print cartridge system shown in FIG. 5 with "reactive" print cartridges on each end and with N being even. Table II shows the equivalent spitting pattern when N is odd.

TABLE I

N (Even) Print Cartridge System with Cartridges 1 and N "Reactive"

| Direction of Carriage Pass over Spitton | Spitting Order |
|---|---|
| Left to Right | Cartridge(N-1), Cartridge(N-2), . . . , Cartridge[(N/2) + 1], Cartridge 1 |
| Right to Left | Cartridge 2, Cartridge 3, . . . , Cartridge (N/2), Cartridge N |

TABLE II

N (Odd) Print Cartridge System with Cartridges 1 and N "Reactive"

| Direction of Carriage Pass over Spittoon | Spitting Order |
|---|---|
| Left to Right | Cartridge(N-1), Cartridge(N-2), . . . , Cartridge[(N/2) + 1.5], Cartridge 1 |
| Right to Left | Cartridge 2, Cartridge 3, . . . , Cartridge[(N/2) + 0.5], Cartridge N |

Table III shows the generalized spitting order for the N print cartridge system shown in FIG. 5 with only one "reactive" print cartridge which is located in cartridge position N. Table IV shows the equivalent spitting pattern when "reactive" print cartridge which is located in cartridge position 1. Tables III and IV apply when the number of print cartridges is either even or odd.

TABLE III

N (Even or Odd) Print Cartridge System with Cartridge N "Reactive"

| Direction of Carriage Pass over Spittoon | Spitting Order |
|---|---|
| Left to Right | Cartridge(N-1) |
| Right to Left | Cartridge 1, Cartridge 2, . . . , Cartridge (N-2), Cartridge N |

TABLE IV

N (Even or Odd) Print Cartridge System with Cartridge 1 "Reactive"

| Direction of Carriage Pass over Spittoon | Spitting Order |
|---|---|
| Left to Right | Cartridge 1 |
| Right to Left | Cartridge 2, Cartridge 3, . . . , Cartridge N |

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of operating an inkjet printing system having a carriage for traversing across a print medium and a spittoon, the carriage having a plurality of N receptacles, the receptacles identified from left to right as positions 1 through N, comprising:

mounting a reactive print cartridge in positions 1 and N on the carriage, where N is an even number, the reactive print cartridges having a plurality of nozzles for ejecting reactive droplets;

mounting a plurality of N−2 print cartridges in positions 2 through N−1 on the carriage, the print cartridges having a plurality of nozzles for ejecting ink droplets; and during operation of the printing system, intermittently ejecting non-printing ink and reactive droplets from the print cartridges in the following order Cartridge(N−1), Cartridge(N−2), continuing through Cartridge[(N/2)+1] and Cartridge 1 while the carriage is moving in a transverse left to right direction and ejecting ink and reactive droplets from the print cartridges in the following order Cartridge 2, Cartridge 3, continuing through Cartridge (N/2) and Cartridge N while the carriage is moving in a transverse right to left direction.

2. The method of claim 1 wherein the reactive droplets are an incompatible ink.

3. The method of claim 1 wherein the reactive droplets are a fixer material.

4. The method of claim 1 wherein the reactive droplets are an overcoat material.

5. The method of claim 1 wherein the ink and the reactive droplets are ejected onto the print media.

6. The method of claim 1 wherein the ink and the reactive droplets are ejected into the spittoon.

7. A method of operating an inkjet printing system having a carriage for traversing across a print medium and a spittoon, the carriage having a plurality of N receptacles, the receptacles identified from left to right as positions 1 through N, comprising:

mounting a reactive print cartridge in positions 1 and N on the carriage, where N is an odd number, the reactive print cartridges having a plurality of nozzles for ejecting reactive droplets;

mounting a plurality of N−2 print cartridges in positions 2 through N−1 on the carriage, the print cartridges having a plurality of nozzles for ejecting ink droplets; and during operation of the printing system, intermittently ejecting non-printing ink and reactive droplets from the print cartridges in the following order Cartridge(N−1), Cartridge(N−2), continuing through Cartridge[(N/2)+1.5] and Cartridge 1 while the carriage is moving in a transverse left to right direction and ejecting ink and reactive droplets from the print cartridges in the following order Cartridge 2, Cartridge 3, continuing through Cartridge[(N/2)+0.5] and Cartridge N while the carriage is moving in a transverse right to left direction.

8. The method of claim 7 wherein the reactive droplets are an incompatible ink.

9. The method of claim 7 wherein the reactive droplets are a fixer material.

10. The method of claim 7 wherein the reactive droplets are an overcoat material.

11. The method of claim 7 wherein the ink and the reactive droplets are ejected onto the print media.

12. The method of claim 7 wherein the ink and the reactive droplets are ejected into the spittoon.

13. A method of operating an inkjet printing system having a carriage for traversing across a print medium and a spittoon, the carriage having a plurality of N receptacles, the receptacles identified from left to right as position 1 through N, comprising:

mounting a reactive print cartridge in position 1 on the carriage, the reactive print cartridge having a plurality of nozzles for ejecting reactive droplets;

mounting a plurality of N−1 print cartridges in position 2 through N on the carriage, the print cartridges having a plurality of nozzles for ejecting ink droplets; and during operation of the printing system, intermittently ejecting non-printing reactive droplets from the print Cartridge 1 while the carriage is moving in a transverse left to right direction and ejecting ink from the print cartridges in the following order Cartridge 2, Cartridge 3, continuing through Cartridge N while the carriage is moving in a transverse right to left direction.

14. The method of claim 13 wherein the reactive droplets are an incompatible ink.

15. The method of claim 13 wherein the reactive droplets are a fixer material.

16. The method of claim 13 wherein the reactive droplets are an overcoat material.

17. The method of claim 13 wherein the ink and the reactive droplets are ejected onto the print media.

18. The method of claim 13 wherein the ink and the reactive droplets are ejected into the spittoon.

19. A method of operating an inkjet printing system having a carriage for traversing across a print medium and a spittoon, the carriage having a plurality of N receptacles, the receptacles identified from left to right as position 1 through N, comprising:

mounting a reactive print cartridge in position N on the carriage, the reactive print cartridge having a plurality of nozzles for ejecting reactive droplets;

mounting a plurality of N−1 print cartridges in positions 1 through N−1 on the carriage, the print cartridges having a plurality of nozzles for ejecting ink droplets; and during operation of the printing system, intermittently ejecting non-printing ink droplets from Cartridge (N−1) while the carriage is moving in a transverse left to right direction and ejecting ink and reactive droplets from the print cartridges in the following order Cartridge 1, Cartridge 2, continuing through Cartridge (N−2) and Cartridge N while the carriage is moving in a transverse right to left direction.

20. The method of claim 19 wherein the reactive droplets are an incompatible ink.

21. The method of claim 19 wherein the reactive droplets are a fixer material.

22. The method of claim 19 wherein the reactive droplets are an overcoat material.

23. The method of claim 19 wherein the ink and the reactive droplets are ejected onto the print media.

24. The method of claim 19 wherein the ink and the reactive droplets are ejected into the spittoon.

* * * * *